United States Patent [19]

Audesse et al.

[11] 4,119,832

[45] Oct. 10, 1978

[54] HERMETICALLY SEALED ELECTRICAL GAS FUEL IGNITER

[75] Inventors: Emery G. Audesse, Williamsport, Pa.; Robert M. Griffin, South Hamilton; Max E. Oberlin, Lynn, both of Mass.

[73] Assignee: GTE Sylvania Incorporated, Danvers, Mass.

[21] Appl. No.: 751,609

[22] Filed: Dec. 17, 1976

[51] Int. Cl.[2] ..... F23Q 7/00; H01C 1/024; H05B 3/44; H01K 1/00

[52] U.S. Cl. ..... 219/270; 13/25; 219/544; 219/548; 219/553; 313/315; 313/317; 338/237; 338/268; 361/266; 431/260

[58] Field of Search ..... 219/260–270, 219/552, 553, 534, 548; 361/264, 265, 266; 431/262, 263; 123/145 R, 145 A; 338/234–237, 218, 240, 242, 267, 268, 273; 13/25

[56] References Cited

U.S. PATENT DOCUMENTS

| | | | |
|---|---|---|---|
| 2,030,937 | 2/1936 | Reichmann | 219/270 X |
| 2,031,985 | 2/1936 | Stoll | 123/145 A |
| 2,215,587 | 9/1940 | Kerschbaum | 338/237 |
| 2,280,977 | 4/1942 | Reichmann | 338/234 |
| 2,372,212 | 3/1945 | Lewin | 338/237 |
| 2,738,967 | 3/1956 | Ferguson | 123/145 A |
| 2,894,107 | 7/1959 | Lefebvre | 338/268 |
| 2,902,578 | 9/1959 | Johnson et al. | 361/264 X |
| 2,910,605 | 10/1959 | Hodge | 219/553 X |
| 2,957,154 | 10/1960 | Strokes | 219/553 X |
| 3,417,270 | 12/1968 | Millikan | 219/553 |
| 3,461,275 | 8/1969 | Poole | 219/553 |
| 3,512,909 | 5/1970 | Perkings | 361/265 X |
| 3,612,822 | 10/1971 | Edin | 219/553 X |
| 3,699,309 | 10/1972 | Eck | 219/553 |

FOREIGN PATENT DOCUMENTS

| | | | |
|---|---|---|---|
| 625,847 | 2/1936 | Fed. Rep. of Germany | 338/268 |
| 475,944 | 6/1915 | France | 219/270 |
| 911,859 | 11/1962 | United Kingdom | 13/25 |

*Primary Examiner*—A. Bartis
*Attorney, Agent, or Firm*—Grover and Meegan

[57] ABSTRACT

An electric heating element for igniting gas fuel comprises a hermetically sealed envelope made of at least 99% pure alumina and filled with a non-oxidizing gas such as hydrogen or one of the inert gases. A self-supporting coiled coil of tungsten or other refractory metal conductor dimensioned to carry a linear power loading of at least one hundred watts per inch is disposed in the envelope with coiling of the coiled coil pressing the peripheral surfaces of the coiled conductor into thermal and mechanical contact with the interior wall of the envelope. Terminals are provided for supplying current to the conductor at said power loading to heat the exterior of the envelope wall to a temperature above 900° centigrade.

4 Claims, 6 Drawing Figures

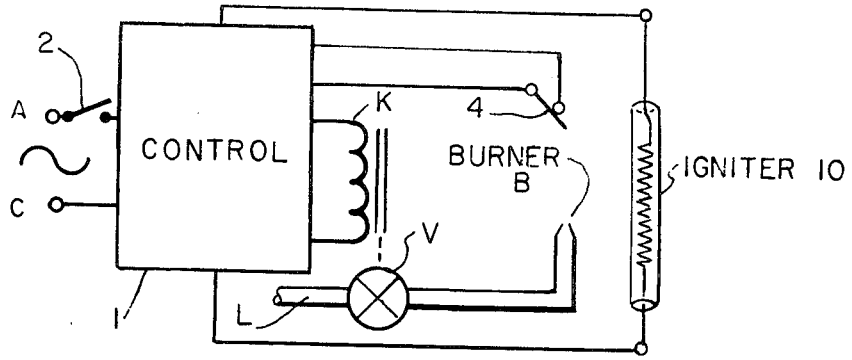
FIG. 1
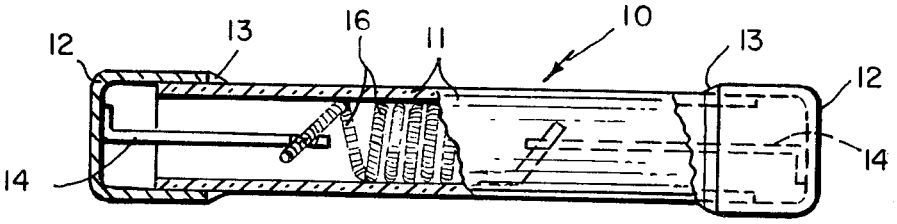
FIG. 2
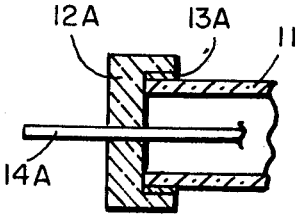
FIG. 3
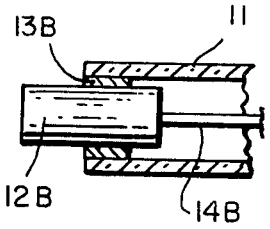
FIG. 4
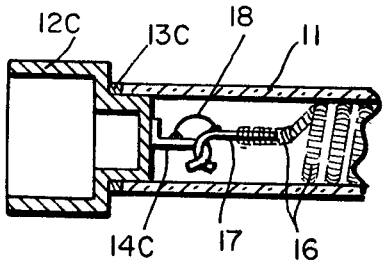
FIG. 5
FIG. 6
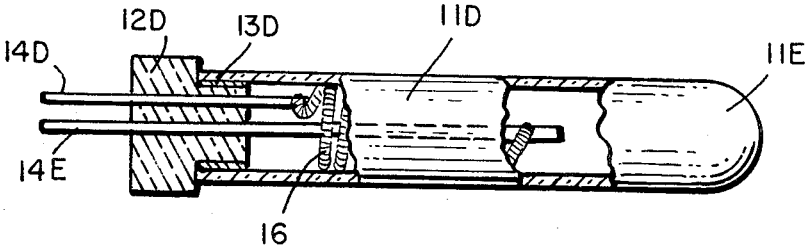

HERMETICALLY SEALED ELECTRICAL GAS FUEL IGNITER

RELATED APPLICATION

Reference is made to the application of Robert M. Griffin, Max E. Oberlin and Robert P. Bonazoli, entitled Ceramic Enveloped Electrical Heating Element, Ser. No. 751,660 filed Dec. 17, 1976.

BACKGROUND OF THE INVENTION

In the continuing energy crisis studies have shown that, for both domestic and industrial gas burning equipment, constantly burning gas pilots consume over one billion dollars of fuel a year in the United States. However small their volume may appear, pilot lights consume about half the fuel supplied to an ordinary gas stove during its life. Also gas burning pilots generate nitrous oxide which may reach hazardous concentration. If the pilots go out they are often inconvenient to light at best, and in many cases require expensive service.

Alternatives to the constant gas burning pilots include electric space discharge (spark) devices or hot wire elements of platinum, nichrome and like metals and alloys, and elements of silicon carbide. Electric discharge igniters require considerable and expensive electrical circuitry. Hot wire igniters are expensive because they require a transformer for supplying suitable operating voltage. Silicon carbide elements on the other hand are extremely fragile and therefore difficult to handle in installation and to protect or replace.

Accordingly the objects of the present invention are to provide a sturdy, inexpensive gas fuel igniter which does not burn fuel but is capable of intermittent or continuous operation without generation of nitrous oxide.

STATEMENT OF INVENTION

According to the invention an ohmic gas fuel igniter comprises a sealed, elongate envelope formed by a wall of at least 99% pure alumina having an operating temperature range to at least approximately nineteen hundred degrees centigrade, a self supporting coiled coil refractory metal conductor dimensioned to carry a linear power loading of at least one hundred watts per inch disposed within the envelope with its peripheral surfaces pressed into thermal and mechanical contact with the interior wall of the envelope by the coiling of the coiled conductor, and conductive means for supplying electrical current to the conductor at said power loading effectively to heat the exterior of the envelope wall to a temperature above nine hundred degrees. The term ohmic is used in the customary sense of electrically resistive. Preferably the envelope is filled with a nonoxidizing gas selected from the group of hydrogen and the inert gases.

DRAWING

FIG. 1 is a schematic diagram of an electrical igniting circuit for a gas burner;

FIG. 2 is an elevation of an (ohmic) electrical resistance unit used in the circuit of FIG. 1, partly broken away;

FIGS. 3 to 6 are elevations showing modifications of the heating unit of FIG. 2.

DESCRIPTION

Shown in FIG. 1 is an ignition system suitable for a gas burner used in a clothes dryer. The system includes the gas burner B itself, supplied from a gas line L through a valve V operated by a solenoid K. The solenoid in turn is operated by a control circuit 1 actuated by the dryer's on-off switch 2. The control circuit 1 also supplies 115 volt alternating current from line terminals A, C through a radiation-sensitive, bimetallic thermostatic switch 4 and an ohmic heating, gas ignition element 10 according to the present invention.

In operation the system of FIG. 1 begins a drying cycle when the dryer switch 2 is turned on. The control 1 applies AC current to the igniter 10 but does not turn gas on until, within about one minute, the igniter reaches gas ignition temperature. The thermostatic switch 4 senses the igniter temperature and causes the control circuit to supply gas to the burner B. Within two or three seconds the gas is ignited by the heater element 10, and thereafter the gas is extinguished and ignited according to the demands of a particular drying cycle.

Other dryers may have continuous burner operation during which the igniter 10 remains energized until the end of the drying cycle. Gas stoves may use igniters energized constantly or on demand. An igniter element suitable for one or more of such various uses should meet the following requirements. It should be inexpensive and capable of operating directly from alternating current expected to vary from 80 to 132 herz, without the use of complex power transfer circuits. It should of course be capable of igniting natural gas or low pressure gases within a few seconds, and toward this purpose should have a power rating of at least 450 watts and should reach a temperature of at least 1000° C. preferably with a capability of 1900° C., and yet be capable of control as by a thermostat. Moreover the element should be sturdy and not subject to fracture in installation, use or replacement. Nor should it deteriorate at such high temperatures by exposure to air. And it is highly desirable and perhaps will become mandatory that the igniter generate no noxious by products such as nitric oxide.

An ignition element meeting the foregoing requirements consists of tubular aluminum ceramic envelope 11 typically 4 inches in length and 0.35 inches in outer diameter with a wall thickness of 0.030 inches. The ceramic is preferably very pure (99%) or extremely pure (99.99%) alumina.

As shown in FIG. 2 the tube is sealed at both ends by end caps 12 of Kovar (Westinghouse Corporation) or Rodar (Wilbur D. Driver Co.) having a coefficient of expansion equal or close to that of the ceramic. Rodar is an iron-nickel-cobalt alloy with a nominal composition of 29% nickel, 17% cobalt and the balance iron. This composition is sold by the Wilbur B. Driver Co. Inc. Kovar is an alloy having a composition of 20% nickel, 17% cobalt, 0.2% manganese, and the balance iron. It is manufactured by Westinghouse Electric Corp. The end caps 12 are hermetically sealed to the alumina tube with a material 13 having adhesive and thermal compatibility with the ceramic, for example Corning Glassworks borosilicate sealing glass No. 7052. Prior to sealing the tube a pair of lead wires 14 holding a heating conductor 16 are secured in the tube. The leads 14 are of Kovar, tungsten or molybdenum appropriate to the end cap material.

The heating conductor 16 is dimensioned to carry a linear power loading of at least one hundred watts per inch and is a self supporting coiled coil of refractory metal such as tungsten, molybdenum or tantalum, all of which have a melting point above 1900° C. For the previously mentioned 0.350 inch OD, 400 watt tube a wire of 0.0103 gauge is wound with a primary coil OD of 0.035 inches at twenty close wound turns per inch; the secondary coil has an OD of about 0.286 inches. The coiled coiling and disposition of the lead wires 14 is such that the coiled coil is positively held in direct thermal and mechanical contact with the interior of the envelope 11 for about a third of the length of the envelope interior. Thus when the coiled coil conductor 16 draws its rated power it will ohmically heat well in excess of the ignition temperature of natural gas (750° C.). In fact the exterior of the ceramic envelope 11 is heated to at least 900° to 1000° C., and the coil may be heated up to 1900° C., the limit for an alumina envelope.

The preferred method of sealing the envelope involves exhausting the envelope in a vacuum furnace, and making the seal in an atmosphere of an antioxidant gas such as hydrogen or the inert gases, e.g. nitrogen or argon, leaving the antioxidant gas as a fill in the envelope.

In FIG. 3 an alternate closure arrangement for the envelope is an alumina end cap 12A sealed by the previously described borosilicate glass No. 7052 at 13A. A lead 14A extends through the end cap 12A.

In FIG. 4 the end of the envelope 11 is closed by a Kovar plug 12B sealed to the envelope interior with borosilicate glass 13B and supporting a lead 14B.

FIG. 5 shows a hollow end plug 12C of refractory metal at whose inner end a hook shaped lead 14C is welded. A spud 17 press fitted into the end coils of the conductor 16 has a hook end interengaging with the lead 14C. The interengagement is bridged by a short refractory wire 18 welded to the lead 14C and spud 17.

FIG. 6 illustrates an envelope 11D with an integral closed end 11E and a single end closure plug 12D at the other end secured to the envelope by borosilicate glass at 13D. Two lead wires 14D and 14E extend through the plug 12D to opposite ends of the envelope where they are welded to respective ends of the coiled conductor 16.

Each of the above heating and ignition elements lacks the fragility and deterioration tendency of air heating elements and does not produce the noxious combustion by products that such elements will cause. The present element operates directly from the common household alternating current line without special transformers or circuitry other than that for programming heating cycles. The coil 16 is supported throughout its length by the rugged envelope and is impervious to atmospheric attack.

It should be understood that the present disclosure is for the purpose of illustration only and that this invention includes all modifications and equivalents which fall within the scope of the appended claims.

We claim:

1. An ohmic heating element for an igniter comprising:

a hermetically sealed, elongate envelope formed by a wall of at least 99% pure alumina and having an operating temperature range to at least 1900° centigrade;

a mechanically and electrically stable self supporting coiled coil of refractory metal conductor dimensioned to carry a linear power loading of at least one hundred watts per inch disposed within the envelope, the coiling of said coiled conductor pressing peripheral surfaces of said coiled conductor into thermal and mechanical contact with the interior wall along substantially all of the coiled portion of the coiled conductor; and conductive means supplying electrical current to the conductor at said power loading effectively to heat the exterior of the envelope wall to a temperature above 900° centrigrade.

2. An element according to claim 1 wherein the envelope is 99.99% pure.

3. An element according to claim 1 wherein the conductor is mechanically and electrically stable at temperatures in excess of 2400° centigrade.

4. An element according to claim 1 wherein the envelope is filled with an antioxidant gas.

* * * * *